US005237967A

United States Patent [19]

Willermet et al.

[11] Patent Number: 5,237,967

[45] Date of Patent: Aug. 24, 1993

[54] POWERTRAIN COMPONENT WITH AMORPHOUS HYDROGENATED CARBON FILM

[75] Inventors: Pierre A. Willermet, Livonia; Arup K. Gangopadhyay, Novi, both of Mich.; Michael A. Tamor, Toledo, Ohio; William C. Vassell, Bloomfield, Mich.

[73] Assignee: Ford Motor Company, Dearborn, Mich.

[21] Appl. No.: 1,989

[22] Filed: Jan. 8, 1993

[51] Int. Cl.[5] ..... F01L 1/14

[52] U.S. Cl. ..... 123/90.51; 123/90.48; 428/408; 428/469

[58] Field of Search ..... 123/90.48, 90.51, 188.3, 123/188.8, 188.9; 428/408, 469, 697, 698, 704

[56] References Cited

U.S. PATENT DOCUMENTS 3,545,415 12/1970 Mori ..... 123/90.51
4,597,844 7/1986 Hiraki et al. ..... 428/408
4,598,675 7/1986 Long ..... 123/90.51
4,661,409 4/1987 Kieser et al. ..... 428/408
4,873,150 10/1989 Doi et al. ..... 123/90.51
4,876,996 10/1989 Mayer et al. ..... 123/90.51
4,909,198 3/1990 Shiraya et al. ..... 123/90.51
4,932,331 6/1990 Kurihara et al. ..... 428/408
4,974,498 12/1990 Lemelson ..... 92/223

*Primary Examiner*—Willis R. Wolfe
*Assistant Examiner*—Weilun Lo
*Attorney, Agent, or Firm*—Roger L. May; Joseph W. Malleck

[57] ABSTRACT

A powertrain component such as a valve lifter (10) for use in an internal combustion engine (12), the valve lifter (10) being positioned between a cam (14) and a valve stem (16). An amorphous hydrogenated carbon film (28) is formed on the component, the film (28) imparting the characteristics of low friction and wear resistance. Also disclosed is an interlayer which improves adherence by imparting the properties of improved absorption of mechanical stresses and chemical compatibility between the film (28) and the substrate (10). Methods for forming the film (28) and interlayer are also disclosed.

17 Claims, 3 Drawing Sheets

POWERTRAIN COMPONENT WITH AMORPHOUS HYDROGENATED CARBON FILM

BACKGROUND OF THE INVENTION

1. Field Of The Invention

The present invention relates to a powertrain component, such as a valve actuation mechanism in an internal combustion engine. More particularly, the invention relates to a component having a hard, wear resistant coating of an amorphous hydrogenated carbon film formed thereupon.

2. Related Art Statement

In most internal combustion engines, there are various powertrain components. Illustrative is a valve actuation mechanism, which includes a valve lifter or tappet positioned between a cam and a valve stem or a rocker arm. As a lobe of the cam moves in relation to the valve lifter, rotational movement of the cam lobe is translated into linear movement of the valve lifter and the valve stem which moves in reciprocal cooperation therewith. Whether or not the powertrain component operates in an oil-starved environment, traditional problems of noise, vibration, and wear have resulted from frictional and normal forces generated between adjacent interacting surfaces, particularly over prolonged periods at high operating temperatures.

Depending on the design of the internal combustion engine, the valve lifter may reciprocate within a guiding aperture formed in a cylinder head. In such situations, the problem of wear caused by adhesion between adjacent surfaces may arise.

Illustrative of approaches to such problems is U.S. Pat. No. 4,909,198, which issued on Mar. 20, 1990. That reference discloses an aluminum alloy valve lifter with an iron-carbon coating sprayed thereupon. Such coatings, however, differ chemically, structurally, and in the method of formation from the invention disclosed and claimed below. The disclosure of U.S. Pat. No. 4,909,198 is herein incorporated by reference.

The notion of selectively applying a synthetic diamond or diamond-like material on certain engine components is disclosed in U.S. Pat. No. 4,974,498 which issued on Dec. 4, 1990. The '498 patent refers to the application of films which are primarily crystalline in nature. Such films are disclosed as having protective utility when formed on specific engine components, such as pistons, piston rings, connecting rods, and crankshaft bearings. Those coatings also are different in composition and morphology from the invention disclosed and claimed below. Moreover, synthetic diamond films tend to be abrasive and may not be generally applicable to powertrain components and engines where there are rubbing contacts.

Formation of carbonaceous films on substrates can be accomplished by several known processes. Such processes include radio frequency (RF), ion beam and microwave plasma chemical vapor deposition (CVD) techniques. If applied satisfactorily, such coatings could reduce friction and wear. Depending on the technique used, several problems may remain. They include delamination of the film in an operating environment, which may be occasioned in part by compressive stresses engendered during deposition at the film/substrate interface. In general, the thicker the film, the higher the compressive stresses engendered during film formation. If such stresses are excessive, delamination may result. Other problems may arise from chemical incompatibility of the substrate and the coating.

As an example, aluminum and its alloys have been among those substrates with which conventional deposition techniques have yielded only marginal results. This is because, in part, aluminum carbides tend to be water soluble and unstable, especially in conditions of prolonged exposure to high humidity. Accordingly, the direct application of carbonaceous films to an aluminum-containing substrate may be intrinsically problematic.

In order to perform their protective role, films have to adhere persistently to the substrate. To do this, the adhesive forces need to overcome the high internal stresses engendered in the film which may otherwise cause the films to delaminate from the substrate. As with other properties, the adhesion of protective films is dependent on the preparation method and obviously the substrate on which they are deposited.

Against this background, the need has arisen to devise a powertrain component and method for preparing a substrate-coating structure which has a reliably adherent hard, wear resistant film, while accommodating compressive stresses generated during film formation and avoiding problems associated with chemical incompatibility between the film and the substrate.

SUMMARY OF THE INVENTION

The present invention discloses a powertrain component, such as a valve lifter, or journal or engine bearing for use in an internal combustion engine and a method for applying a hard, wear resistant film which firmly adheres to the component. The present invention also discloses a powertrain component with an amorphous hydrogenated carbon film which significantly reduces friction and wear. Also disclosed is an interlayer system for improving adherence and ability to withstand mechanical stresses.

Conventionally, the valve lifter, as illustrative of other powertrain components to which the disclosed invention is applicable, is positioned between a cam and a valve stem. Traditional valve lifters have a hollow cylindrical body with a sidewall culminating at its upper end in a cam-facing surface which cooperates with a cam. Located below the cam-facing surface is a stem-facing surface which cooperates with the valve stem.

An amorphous hydrogenated carbon film with up to 20–60 atomic percent of hydrogen is formed on the sidewall of the hollow cylindrical body. Unlike crystalline diamond films, hydrogenated carbon films, being devoid of crystallinity, are amorphous in nature and have very smooth surfaces which impart a low coefficient of friction.

In an alternative embodiment, an amorphous hydrogenated carbon film is formed on the cam-facing surface of the valve lifter.

Another embodiment includes an amorphous hydrogenated carbon film formed on the stem-facing surface.

Thus, wear and abrasion resistant amorphous hydrogenated carbon film may be formed on some or all of the wear surfaces of the component.

Accordingly, an object of the present invention is to provide a powertrain component such as a valve lifter for use in an internal combustion engine and a method for applying a hard, wear resistant film which firmly adheres to the component. In such an environment, an amorphous, hydrogenated carbon film is formed thereupon to impart the characteristics of low friction and wear resistance.

Another object of the invention is to provide an amorphous hydrogenated carbon film on the cam-facing surface of the valve lifter.

Yet another object of the present invention is to provide an amorphous hydrogenated carbon film on the stem-facing surface of the valve lifter.

Still yet another object of the present invention is to provide an interlayer between the amorphous hydrogenated carbon film and the component, the interlayer serving to improve adherence of the film to the component by accommodating compressive stresses and avoiding problems of chemical incompatibility.

A further object of the present invention is to provide a satisfactory film-interlayer-substrate system wherein the substrate is less problematic than aluminum-containing substrates, such as steel or ceramics, by providing an appropriately chosen interlayer which can improve adherence while providing additional mechanical support to a load-bearing surface.

The above-noted objects may be realized on powertrain and engine components other than on the valve actuation mechanism itself.

BEST MODES FOR CARRYING (OUT THE INVENTION

Figure 1:
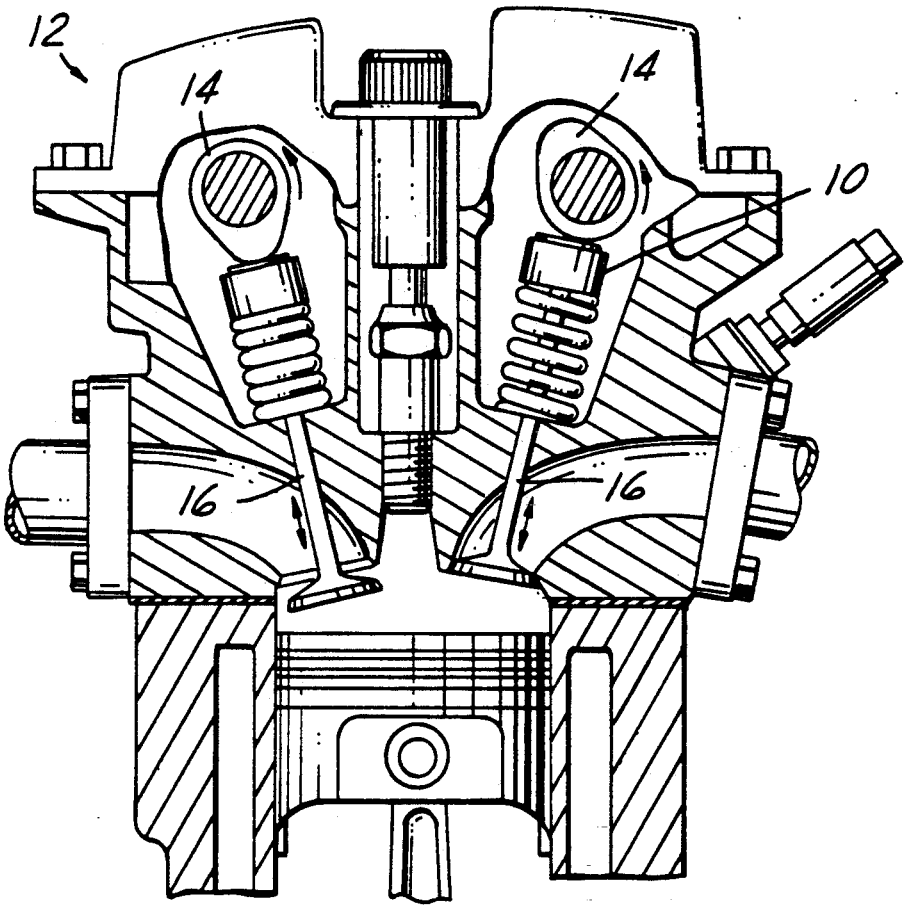
FIG. 1 is a schematic sectional view of an internal combustion engine including a valve lifter as illustrative of other powertrain components which exhibit the facets of the present invention.
Figure 2:
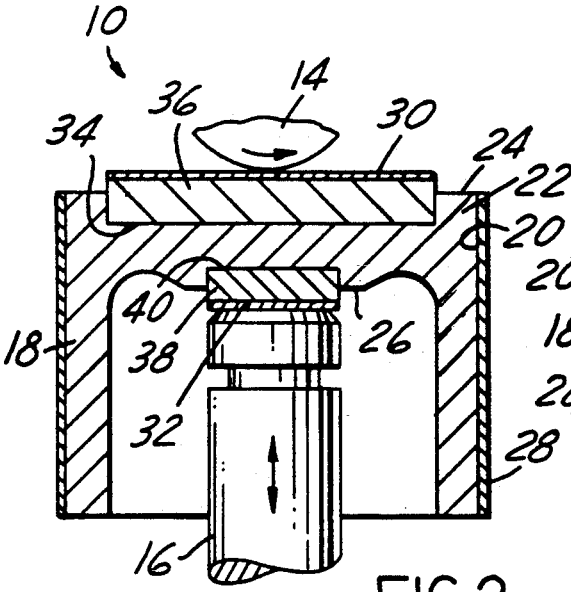
FIG. 2 is a schematic sectional view of the valve lifter according to the present invention.
Figure 3:
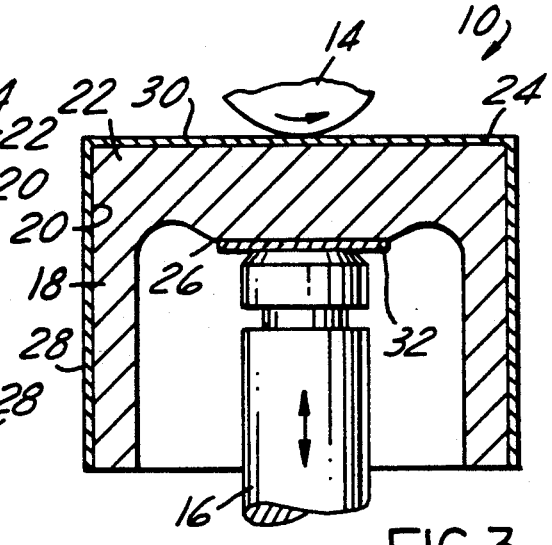
FIG. 3 is a schematic sectional view of an alternate embodiment of the valve lifter according to the present invention.

Turning first to FIGS. 1-3 of the drawings, there is depicted, as illustrative of other powertrain components, a valve lifter 10 for use in an internal combustion engine 12 under conditions which may or may not be oil-starved. Typically, the valve lifter is interposed between a cam 14 and a valve stem 16. Often, the valve lifter reciprocates within a guide channel formed within the cylinder head, between which frictional forces may be generated.

The valve lifter 10 has a hollow cylindrical body 18 with a continuous sidewall 20. At an upper end 22 of the sidewall 20 is a cam-facing surface 24 which cooperates with the cam 14. Disposed below the cam-facing surface 24 within the hollow cylindrical body 18 is a stem-facing surface 26 which cooperates with the valve stem 16.

Figure 5:
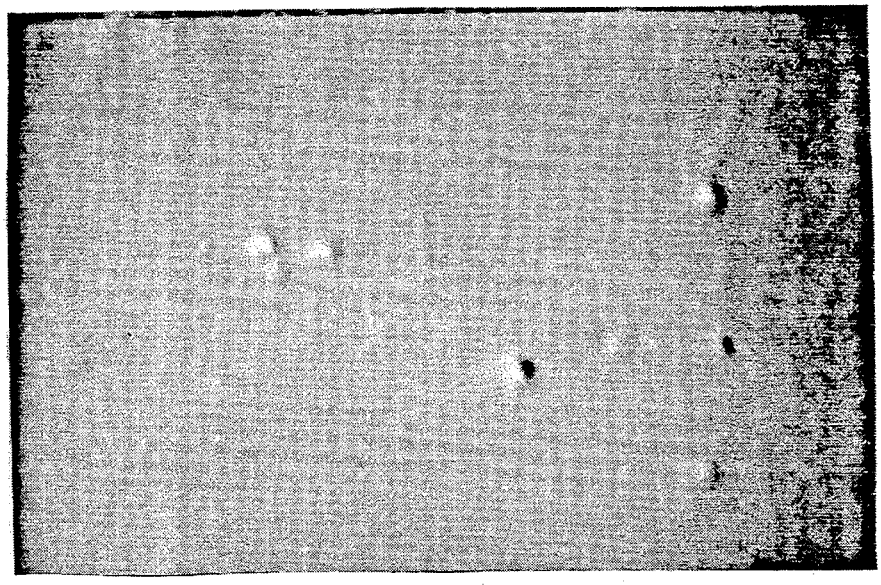
FIG. 5 is a scanning electron micrograph of the coating of the present invention, illustrating its amorphous nature and absence of crystallinity.

To impart the characteristics of low friction and wear resistance to the valve lifter 10, an amorphous hydrogenated carbon film 28 is formed on one or more wear surfaces, such as the sidewall 20 of the body 18. Characteristic of such films is the absence of evidence of any pattern, structure, or crystallinity which is discernable by X-ray diffraction techniques (FIG. 5).

As a result, the valve lifter 10 can be operated, even without effective lubrication in an oil-starved environment, for prolonged periods. Without such a coating, most valve lifters fail—especially in an oil-starved environment—if made of materials like aluminum, which characteristically exhibits poor wear resistance. Failure may result in seizure and welding.

The coatings of the present invention are attractive because aluminum, for example, of which some powertrain components are made, is generally not durable under high loading conditions. Amorphous hydrogenated carbon films are therefore useful in protecting such substrates, especially in conditions of marginal lubrication. An example related to the disclosed invention concerns the deposition of an adherent film with a composition gradient on a powertrain component, such as a valve lifter. Details of such coating systems are described in co-pending, commonly assigned U.S. patent application Ser. No. 08/002,490 filed on even date herewith by Pierre A. Willermet, Arup K. Gangopadhyay, Michael A. Tamor, and William C. Vassell entitled "POWERTRAIN COMPONENT WITH ADHERENT AMORPHOUS FILM WITH A GRADED COMPOSITION," the disclosure of which is hereby incorporated by reference.

Details of a ceramic coating system on such components is described in co-pending, commonly assigned U.S. patent application Ser. No. 08/002,190, filed on even date herewith by Pierre A. Willermet, Arup K. Gangopadhyay, Michael A. Tamor, William C. Vassell, and Margherita Zanini-Fisher entitled "POWERTRAIN COMPONENT WITH ADHERENT AMORPHOUS OR NANOCRYSTALLINE CERAMIC COATING SYSTEM," the disclosure of which is hereby incorporated by reference.

As illustrated in FIG. 2, the cam-facing surface 24, in the preferred embodiment, is provided with an annular recess 34. A cylindrical shim 36 is received within the annular recess 34. In this embodiment, the amorphous hydrogenated film is formed on the shim 36 upon a surface which faces the cam. Preferably, the shim 36 is made of steel or a powdered metal. Optionally, an orifice may be defined within the annular recess 34, which can be used for removing the shim 36.

Continuing with reference to FIG. 2, formed within the stem-facing surface 26 is a bottom recess 40 which receives a chip 38. In this embodiment, the amorphous hydrogenated carbon film 32 is formed on the surface of the chip 38 which faces the valve stem 16. In operation, the chip 38 may be made from steel (e.g. AISI 4340) or a powdered metal.

FIG. 3 illustrates an alternate embodiment of the invention, wherein the amorphous hydrogenated film 30, 32 is formed directly on both of the cam-facing and stem-facing surfaces 24, 26 respectively. It will readily be appreciated that the amorphous hydrogenated film may alternatively be formed on any two or three of the sidewall 20, and the cam- and stem-facing surfaces 24, 26 respectively.

In the alternate embodiment, the shim 36 and chip 38 are eliminated. Deposition occurs directly on the operationally interfacing surfaces 20, 24, 26 of the valve lifter 10. This offers an advantage over the embodiment of FIG. 2 of eliminating one or more manufacturing steps.

Besides the valve actuation mechanisms discussed above and depicted in FIG. 1-3, other valve actuation mechanisms exist, to which the disclosed invention lends itself. They include such valve actuation mechanisms as a center pivot rocker system, a push rod, a finger follower with a roller, and a direct acting bucket type (of which FIGS. 1-3 are illustrative).

An interlayer formed between the film and the substrate may comprise a continuously or abruptly varying composition gradient which enables surface engineering of a wide variety of film-interlayer-substrate systems to enhance friction, wear, and chemical compatibility. Additionally, such a graded interlayer permits simultaneous optimization of adhesion to the substrate, mechanical properties and stress state of the interlayer, and friction and wear properties of the surface.

For low load applications (such as compact disks and disk drives), the chemical incompatibility component of the adherence problem can, to some extent, be ameliorated by providing a suitable thin interlayer. But for high load applications, such as those found in automobiles, the interlayer must be capable of accommodating relatively high concomitant mechanical stresses. In such environments, the interlayer system must be so selected as to overcome the intrinsic limitations due to internal stresses engendered by, for example, the deposition of a carbonaceous film on an aluminum-containing substrate. In that example, it has been found that silicon forms a stable aluminum silicide and silicon carbide at the inter facial layers between the interlayer, the substrate, and the film.

Preferably, where the substrate is of a relatively soft material, such as aluminum, the interlayer should be relatively thick (exceeding >1 micron). The provision of a relatively thick (exceeding >1 micron) silicon interlayer serves to improve adhesion and durability of low-wear coatings on mechanical components which are subject to sliding contact, rolling contact, or both. For example, a 3 micron silicon interlayer results in a system having a performance akin to that exhibited by a carbonaceous film when applied directly to steel. Depending on the substrate material and component operating conditions, the interlayer may have a thickness between 200 angstroms and 30 microns.

As noted earlier, the provision of hard, wear resistant coatings, such as hydrogenated carbon films, is often accompanied by intrinsic compressive stress. Where a thick silicon interlayer is interposed, for example, adhesion is improved, and a mechanical support layer which distributes contact stress is provided, thereby improving film durability of a given thickness.

Hydrogenated carbon films are of interest because of their attributes of high hardness and wear resistance. Such films consist of isolated $sp^2$ carboncarbon (C-C) bonded (graphitic) clusters, the size of which is no larger than 30-40 Angstroms. These clusters may in turn be linked by $sp^3$ C-C bonds to form a rigid three dimensional structure. The film imparts the characteristics of low friction and wear resistance to the component.

FIG. 5 is helpful in illustrating the amorphous nature of the hydrogenated carbon film. Noteworthy is the absence of a crystalline structure which would generally typify synthetic diamond coatings. The absence of crystal structure is confirmed by x-ray defraction techniques.

Depending upon the conditions, hydrogenated carbon films may contain large amounts (20-60 atomic percent) of hydrogen. The amount of hydrogen incorporated in the film and the preparation conditions strongly influence the properties of the resulting coating. Optimum results occur in the 35-50 atomic percent range. Hydrogen content of the films also determines to a great extent the ratio between the carbon atoms in the different $sp^2$, $sp^3$, and even $sp^1$ coordinations.

As noted above, such films can be deposited by various techniques, including direct current (DC), radio frequency (RF) plasma-assisted chemical vapor deposition (CVD), ion beam deposition, and arc discharge techniques.

A preferred way of depositing the disclosed coatings is in a capacitively coupled parallel plate RF-driven plasma reactor. Good results have been obtained where a table upon which the powertrain component to be coated is supported and a target (if one is used) are water-cooled. The entire assembly generally is enclosed in a vacuum chamber. Advantageously, the substrate may be cleaned and degreased by ultrasonic cleaning in a detergent (such as Alconox) and a solvent (such as acetone).

The degreased component is then inserted into the parallel plate reactor within a vacuum chamber, which is then evacuated to a system base pressure which is $10^{-6}$ torr or less in order to minimize oxygen from ambient water vapor.

The substrate is further cleaned by a sputtering technique using an inert gas such as argon by ion bombardment. This entails admitting argon gas to a pressure in the range of 1 to 100 milli-torr and directing all RF-power to the substrate. This generates a large negative potential relative to the plasma, which draws ions from the plasma and accelerates them to the substrate. Chemically inert argon ions dislodge other atoms, thereby cleaning the substrate.

The deposition of an hydrogenated carbon film is commenced by starting the flow of hydrocarbon vapor, while sputter etching is still in progress. Hydrocarbon ions are accelerated to the substrate, thereby forming the amorphous hydrogenated carbon film. Optimum film properties are obtained when ion kinetic energy is in the range of 50 to 200 electron volts per carbon atom in the impinging ion. The hydrocarbon source is preferably methane, but possible substituents include ethane, ethylene, acetylene, benzene, butane, propane, hexane, toluene, and xylene. The flow of inert gas is then stopped. As the gas mixture gradually changes from etching to deposition, a mixed carbon-substrate or carbon-interlayer transition layer assures good adhesion of the hydrogenated carbon film. Deposition is then continued until a desired film thickness is attained.

If desired, an interlayer may be sputterdeposited before carbon film deposition by directing most of the RF-power to a sputtered target (another electrode). This shift is performed continuously without shutting off the plasma, so that all surfaces remain very clean at all times. The target then takes on a large potential relative to the plasma and it becomes sputter-etched with dislodged atoms depositing on the substrate.

For many applications, the interlayer may be formed from silicon. It should be realized, however, that in some environments, the deployment of a tungsten, titanium, or germanium interlayer may be made with good results. In general, the selection of a suitable interlayer tends to be guided by availability of an interlayer material which tends not to be water soluble in liquid form and exhibits stability as a carbide.

In operation, when methane is used as the carbon source, the RF technique results in a deposition rate of about 1 micron per hour where the applied negative bias voltage is 500 volts rms. Microwave techniques under similar conditions are faster, and enable a deposition layer to be formed of about 2 microns per hour. If higher molecular weight precursors such as butane and benzene are used as the carbon source, even faster deposition rates are possible.

The films prepared by RF plasma techniques which use a hydrocarbon gas (e.g. methane) as the source of carbon may contain hydrogen in concentrations as high as 60 atomic percent. Hydrogen is linked to carbon atoms as $CH_1$, $CH_2$, and $CH_3$ bonds.

Figure 4A:
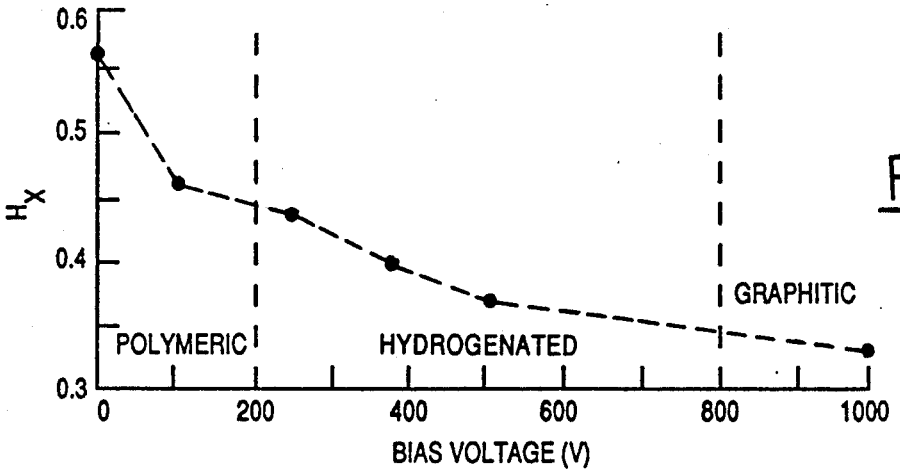
FIG. 4A is a graph of hydrogen concentration in a hydrogenated carbon film in relation to the negative bias voltage applied during deposition.
Figure 4B:
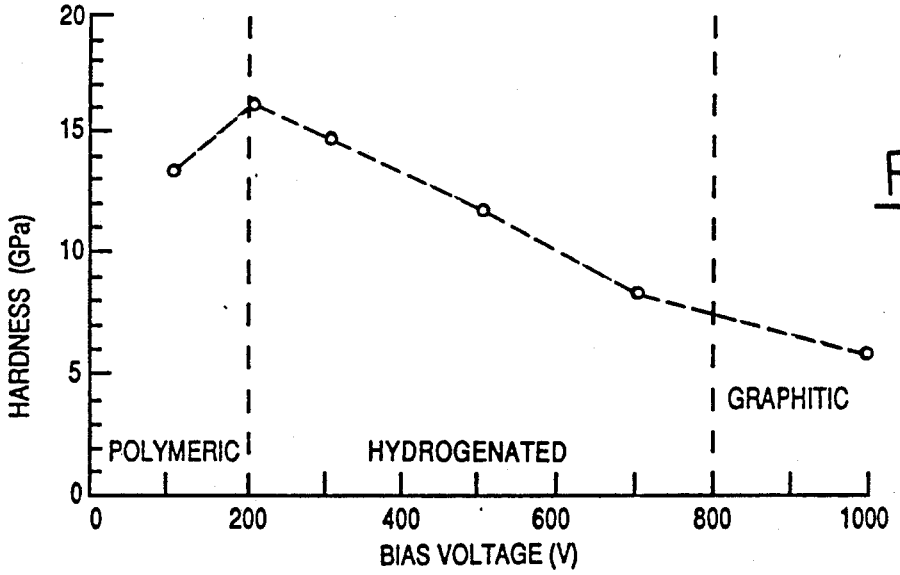
FIG. 4B is a graph illustrating the hardness of hydrogenated carbon films deposited at different bias voltages.
Figure 4C:
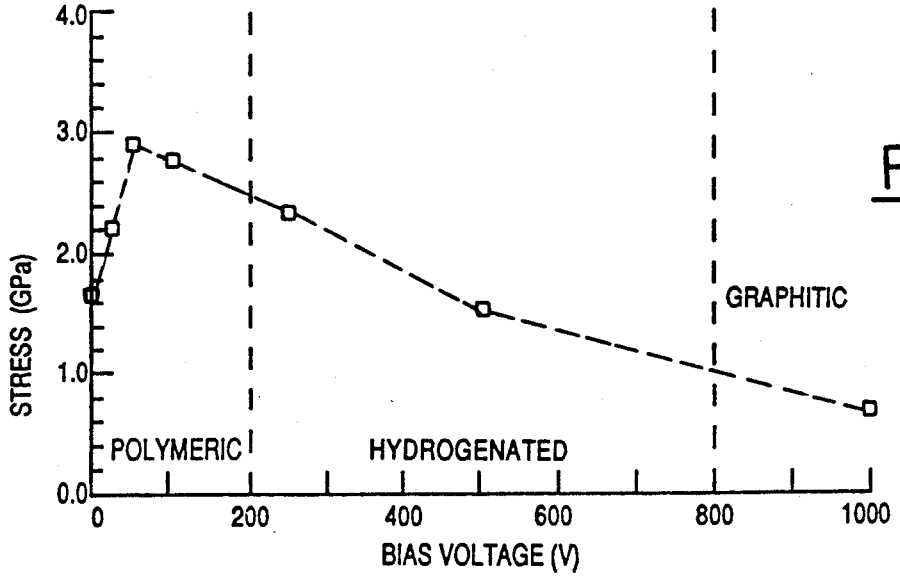
FIG. 4C is a graph illustrating the variation of compressive stress within the hydrogenated carbon film with bias voltage.

Certain properties related to tribological behavior in the films, i.e., hydrogen concentration, hardness, and residual compressive stress are illustrated in FIGS. 4A–4C.

As illustrated in FIG. 4A, the composition and morphology of hydrogenated carbon films depends on the negative bias voltage applied (and on the type of gas used as the carbon source). The disclosed films are deposited from methane, although (as noted above) other carbon sources may be used. If deposited at low bias voltages, the films are characteristically organic, or polymer-like. They tend to flow under stress. In such films, the hydrogen content may approach 60 atomic percent and the C-C bonding is predominantly $sp^3$. As the bias voltage increases, the hydrogen content of the film decreases. This is probably because the increasing bombardment of the films during growth removes weakly bonded hydrogen. In turn, this phenomenon leads to increased C-C bonding.

Between 200 v and 800 v rms bias (corresponding to ion kinetic energy in the range of 50 to 200 electron volts), the reduced hydrogen content and the high $sp^3/sp^2$ ratio produce the desired hydrogenated carbon structure. Above 800 v rms, the low hydrogen content and the greater degree of $sp^2$ bonding produce a graphite-like film.

The mechanical properties of amorphous hydrogenated carbon films, e.g. hardness, elastic modulus, Poisson's ratio, etc. depend on the bias voltage, in addition to the type of hydrocarbon gas used during deposition. The hardness of the films deposited at different bias voltages is shown in FIG. 4B. Hardness reaches a peak, about 16 Gpa—as measured by nanoindentation techniques—for hydrogenated carbon films deposited at 200–250 rms bias voltage. Such hardness values are substantially equivalent to 30 GPa when measured by more conventional methods, such as the Vickers test. Hardness decreases monotonically at higher bias voltages. The high hardness of hydrogenated carbon films probably arises from an over-constrained extended network in which small graphitic clusters are captured. The durability of hydrogenated carbon films is optimal at bias voltages ranging from 200 v to 800 v rms.

As noted earlier, hydrogenated carbon films deposited by CVD typically contain large compressive stresses which may sometimes cause buckling of the film. The compressive stress exerted by the film is illustrated in FIG. 4C. The stress is small for polymer-like films, increases to a maximum near 50 v, then decreases monotonically and almost vanishes at 1000 v. As with observations noted earlier, without wishing to be bound by any particular theory, it appears that the decrease in stress may be related to reduced hydrogen content and a transition from an amorphous to a graphite-like morphology with increasing bias voltage.

The disclosed films may be usefully applied to various components, such as engine and journal bearings, besides a valve stem and a valve guide. Other applications include the use of hydrogenated carbon films at the piston-cylinder interface, and on swash plates used in compressors.

Thus far in the disclosure it has been contemplated that the substrate valve lifter 10 may preferably be formed from an aluminum-silicon alloy containing aluminum and about 11.6 atomic percent of silicon, 0.4 atomic percent of iron, 4.0 atomic percent of copper, 0.64 atomic percent of magnesium, and 0.05 atomic percent of titanium. When it is desired to deposit hydrogenated carbon films on other structural metals, such as ferrous alloys (including steel), the adhesion of hydrogenated carbon film may require the deposition of the interlayer, as discussed above. When it is desired to deposit hydrogenated carbon films on ferrous alloys, a new difficulty tends to arise because carbon has a high solubility in ferrous alloys. In such cases, the interposition of an adherent interlayer may serve as an effective barrier between the substrate and the film. Suitable substrates may include aluminum-copper-silicon alloys, ceramics, and the like.

Hydrogenated carbon films are smooth ($R_a=10$ nanometers) and exhibit friction coefficients in the range of 0.02–0.2 under unlubricated sliding contact against silicon nitride, sapphire, and several metals including steel. Such friction coefficients can be considered low for an unlubricated sliding contact. In addition to low friction coefficients, hydrogenated carbon films also exhibit excellent wear resistance.

At low relative humidity, hydrogenated carbon films exhibit friction coefficients in the range of 0.05–0.16 under a contact stress ranging from 0.83 to 1.5 GPa and a sliding speed ranging from 0.03 to 1 meter per second.

Accordingly, there has been provided in accordance with the present invention an improved powertrain component for use in an engine, such as a valve lifter, and its method of preparation. The valve lifter includes one or more films which impart the characteristics of low friction and wear resistance to the component. As a result, the average service intervals required by the component tend to be prolonged and therefore less frequent.

What is claimed is:

1. A powertrain component in an internal combustion engine, the powertrain component including a valve lifter interposed between a cam and a valve stem, and being provided with a hollow cylindrical body with a sidewall culminating at its upper end in a cam-facing surface which cooperate with the cam, and a stem-facing surface which cooperates with the valve stem, the component comprising:

an amorphous hydrogenated carbon formed on at least a portion of an outer surface of the component without detrimental change in the physical properties of the component, the film imparting characteristics of low friction and wear resistance to the component;

an interlayer formed between the amorphous hydrogenated carbon film and the component, the interlayer being selected from a group comprising at least one of a non-carbon form of tungsten, titanium, and germanium, the interlayer accommodating stresses engendered by formation of the amorphous hydrogenated carbon film, thereby improving adherence of the amorphous hydrogenated carbon film to the component.

2. The valve lifter of claim 1 wherein:

the amorphous hydrogenated film is formed on the cam-facing surface.

3. The valve lifter of claim 1 wherein:

the amorphous hydrogenated film is formed on the sidewall.

4. The valve lifter of claim 1 wherein:

the amorphous hydrogenated film is formed on the sidewall and the cam-facing surface.

5. The valve lifter of claim 1 wherein:

the amorphous hydrogenated film is formed on the sidewall and the stem-facing surface.

6. The valve lifter of claim 1 wherein:

the amorphous hydrogenated film is formed on the sidewall and the stem-facing surfaces.

7. The valve lifter of claim 1 wherein:

the amorphous hydrogenated film is formed on the sidewall and the stem-facing and the cam-facing surfaces.

8. The valve lifter of claim 1 wherein:

the cam-facing surface defines therewithin a recess; and a shim is received within the recess.

9. The valve lifter of claim 8 further including:

the amorphous hydrogenated carbon film is formed on the shim on a surface thereof which faces the cam.

10. The valve lifter of claim 1 wherein:

the stem-facing surface defines therewithin a recess; and a chip is received within the recess.

11. The valve lifter of claim 10 wherein:

the amorphous hydrogenated carbon film is formed on the chip on a surface thereof which faces the valve stem.

12. The powertrain component of claim 1 wherein the interlayer has a thickness between 200 angstroms and 30 microns.

13. The powertrain component of claim 1 wherein the film includes hydrogen in concentrations of 20–55 atomic percent.

14. The powertrain component of claim 1 wherein the amorphous hydrogenated carbon film is formed from a source of hydrogen and carbon, the source comprising at least one of ethane, ethylene, acetylene, methane, butane, propane, hexane, benzene, toluene, and xylene.

15. The powertrain component of claim 1 wherein the powertrain component is formed from at least one of aluminum, an aluminum-silicon alloy, and an aluminum-copper-silicon alloy.

16. The valve lifter of claim 1, wherein:

the amorphous hydrogenated carbon film is formed on the stem-facing surface.

17. An internal combustion engine having a valve lifter therein, the valve lifter being positioned between a cam and a valve stem, the valve lifter having:

a hollow cylindrical aluminum body with a continuous sidewall;

an amorphous hydrogenated carbon film formed on at least a portion of an outer surface of the lifter, the film imparting characteristics of low friction and wear resistance to the valve lifter; and an interlayer formed between the amorphous hydrogenated carbon film and the lifter, the interlayer accommodating stresses engendered by formation of the amorphous hydrogenated carbon film, the interlayer thereby improving adherence of the amorphous hydrogenated carbon film to the lifter, the interlayer being selected from the group comprising at least one of a non-carbon form of a tungsten, titanium, and germanium.

* * * * *

UNITED STATES PATENT AND TRADEMARK OFFICE

CERTIFICATE OF CORRECTION

PATENT NO. : 5,237,967

DATED : August 24, 1993

INVENTOR(S) : Pierre A. Willermet et al

It is certified that error appears in the above-indentified patent and that said Letters Patent is hereby corrected as shown below:

Column 3, line 49, in the subtitle, delete "(OUT" and substitute --OUT--.

Column 7, line 49, delete "Gpa" and substitute --GPa--.

Column 8, line 55, Claim 1, delete "cooperate" and substitute --cooperates--.

Column 9, line 21, Claim 6, delete "sidewall" and substitute --cam-facing--.

Column 10, line 38, Claim 17, after "from" delete "the" and substitute --a--.

Column 10, line 39, Claim 17, after "form of" delete "a".

Column 9, line 21, delete "the".

Signed and Sealed this

Twelfth Day of April, 1994

Bruce Lehman

*Attest:*

BRUCE LEHMAN

*Attesting Officer*

*Commissioner of Patents and Trademarks*